US006031194A

United States Patent [19]

Aoki

[11] Patent Number: 6,031,194

[45] Date of Patent: Feb. 29, 2000

[54] SLIDE SWITCH WITH SELF CLEANING STRUCTURE INCLUDING GROOVES IN RECTANGULAR SUBSTRATE

[75] Inventor: Yoshiyuki Aoki, Aichi, Japan

[73] Assignee: Kabushiki Kaisha Tokai Rika Denki Seisakusho, Aichi, Japan

[21] Appl. No.: 09/091,903

[22] PCT Filed: Dec. 24, 1996

[86] PCT No.: PCT/JP96/03826

§ 371 Date: Jun. 26, 1998

§ 102(e) Date: Jun. 26, 1998

[87] PCT Pub. No.: WO97/24743

PCT Pub. Date: Jul. 10, 1997

[30] Foreign Application Priority Data

Dec. 28, 1995 [JP] Japan ..... 7-353250

[51] Int. Cl.[7] ..... H01H 1/60; H01H 15/02

[52] U.S. Cl. ..... 200/253; 200/16 C; 200/16 D; 200/550

[58] Field of Search ..... 200/16 R, 16 C, 200/16 D, 16 B, 16 E, 16 F, 61.09, 242, 252–270, 304–306, 292; 335/201

[56] References Cited

U.S. PATENT DOCUMENTS

| | | | |
|---|---|---|---|
| 3,531,799 | 9/1970 | Rendler | 200/11 R |
| 3,805,200 | 4/1974 | Suzuki | 335/201 |
| 4,518,834 | 5/1985 | Paranicas | 200/16 C |
| 4,677,425 | 6/1987 | Singleton | 200/61.09 X |
| 5,672,854 | 9/1997 | Nishio | 200/16 R |
| 5,708,240 | 1/1998 | Akimoto et al. | 200/16 C |
| 5,783,785 | 7/1998 | Furukawa | 200/16 C X |
| 5,898,142 | 4/1999 | Ohtaki et al. | 200/16 C |

FOREIGN PATENT DOCUMENTS

| | | |
|---|---|---|
| 19 04 616 | 8/1970 | European Pat. Off. . |
| 90 10 973 U | 11/1990 | European Pat. Off. . |
| 39 17 864 | 12/1990 | European Pat. Off. . |
| 53-86478 | 7/1978 | Japan . |
| 57-104422 | 6/1982 | Japan . |

*Primary Examiner*—J. R. Scott
*Attorney, Agent, or Firm*—Morgan, Lewis & Bockius LLP

[57] ABSTRACT

A slide switch that can remove foreign particles, such as metallic dust, from its ground terminals. When the movable contact slides toward a stroke end, the power source contact first passes through an end section of the power source terminal before disengaging the terminal. At that instant, arcs are generated between the contact and the terminal. Arcs produce metallic dust, carbide particles, etc. that adhere to the insulator and terminals creating buildup and obstructing the sliding path of the contacts. The switch is provided with a discharge hole and arc gaps along the sliding path of the contacts to eliminate the arc buildup. The contacts carry the metallic dust and carbide particles while sliding so that the dust and particles drop into the discharge hole or arc gap.

15 Claims, 2 Drawing Sheets

SLIDE SWITCH WITH SELF CLEANING STRUCTURE INCLUDING GROOVES IN RECTANGULAR SUBSTRATE

FIELD OF THE INVENTION

The present invention relates to a slide switch to close a current feed circuit to a load by connecting a ground terminal to a power source terminal by means of a movable contact, which is slidable.

DISCUSSION OF THE PRIOR ART

Arcs are generated when the switch is operated. At this time, foreign particles, e.g., metallic dust and carbide particles, are produced and scattered. An arc gap is formed at the power source terminal of the arc generating side to receive the foreign particles.

The foreign particles are scattered and also adhere to the ground terminal as a common terminal. No measure is taken for the foreign particles in the ground terminal side. The movable contact slides on the ground terminal while pressing the foreign particles against the ground terminal, and the ground terminal is worn. As a result, the switch may develop a poor contact and a drop, and smooth operation of the switch is impaired.

Accordingly, an object of the present invention is to provide an improved slide switch such that the foreign particles adhering to the ground terminal as the common terminal can be automatically discharged.

DISCLOSURE OF THE INVENTION

To achieve the above object, a slide switch is provided to close a current feed circuit to a load by connecting a ground terminal to a power source terminal by means of a movable contact, which is slidable. The improvement being characterized by a discharge hole that is formed in said ground terminal to be in contact with said movable contact when said movable contact slides, and metallic particles, carbide particles and the like, which are produced by arcs generated at the time of switching and adhere to said ground terminal, are put into said discharge hole through the sliding motion of said movable contact.

With such a construction, foreign particles, e.g., metallic particles and carbide particles, which are produced by the arcs and scattered and adhere onto the ground terminal, are gathered through the sliding motion of the movable contact, and the gathered ones drop into the discharge hole, whereby the foreign particles are removed from the ground terminal. Therefore, the foreign particles are not put between the movable contact and the ground terminal, and the ground terminal is worn every sliding motion of the movable contact. In this respect, the durability of the slide switch is improved. A contact state between the movable contact and the ground terminal is stable. No voltage drop occurs. Further, smooth operation of the switch is ensured.

DESCRIPTION OF THE PREFERRED EMBODIMENTS

Figure 1:
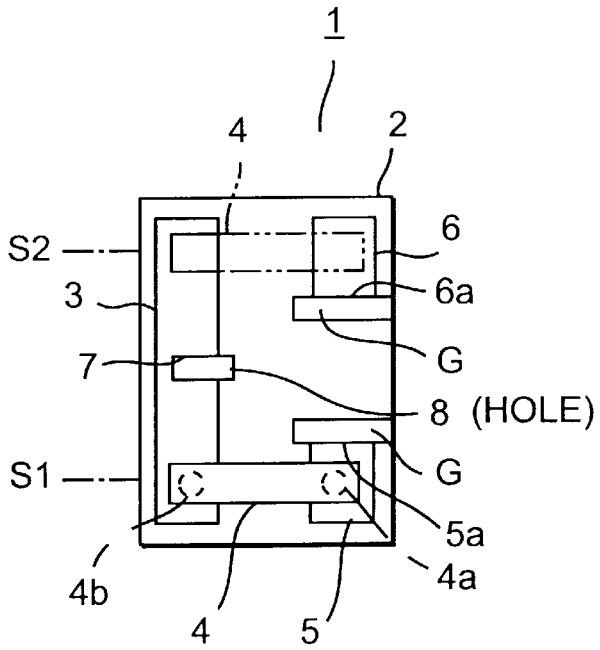
FIG. 1 is a plan view schematically showing a slide switch 1.
Figure 2:
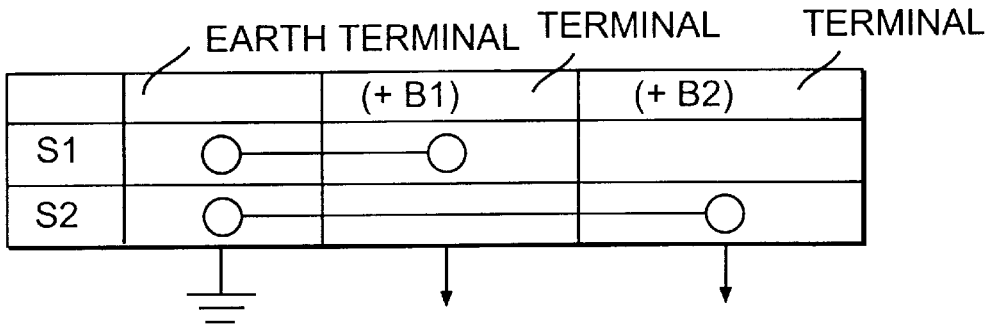
FIG. 2 is a table showing interconnections of the terminals in the slide switch.

Preferred embodiments of the present invention will be described with reference to the accompanying drawings. FIG. 1 is a plan view schematically showing a slide switch 1 which an embodiment of the present invention. FIG. 2 is a table showing interconnections of the terminals in the slide switch 1. As shown, a strip-shaped ground terminal 3 as a common terminal is provided on an insulator 2 of the slide switch 1. A (+B1) terminal 5 and a (+B2) terminal 6 as power source terminals are arrayed, while being spaced from and along with the ground terminal 3, at the locations corresponding to the stroke ends S1 and S2 of a stroke of a movable contact 4. The movable contact 4, which is urged by a spring (not shown), slides to bring its contacts 4*a* and 4*b* respectively into contact with the ground terminal 3 and the (+B1) terminal 5, and with the ground terminal 3 and the (+B2) terminal 6. In other words, the movable contact 4 bridges the gap between the ground terminal 3 and the (+B1) terminal 5, and the gap between the ground terminal 3 and the (+B2) terminal 6.

A mid position of the ground terminal 3 that is located between the stroke ends S1 and S2 is notched to form a notch hole section 7, which is provided for discharging the foreign particles. A discharge hole 8 is formed in the insulator 2 at a position corresponding to the notch hole section 7, as shown. Arc gaps G are formed in the insulator 2. Those arc gaps are disposed adjacent to and along the ends 5*a* and 6*a* of the (+B1) terminal 5 and the (+B2) terminal 6. When the movable contact 4 slides to and comes in contact with the (+B1) terminal 5 (the (+B2) terminal 6) and slides to leave the same, arcs are generated at the end 5*a* (6*a*).

The operation of the slide switch 1 will be described. It is assumed that the movable contact 4 is positioned at the stroke end S1 while connecting the ground terminal 3 to the (+B1) terminal 5. When the movable contact 4 slides from this position to the stroke end S2, the contact 4*a* of the movable contact 4 passes and leaves the end 5*a* of the (+B1) terminal 5. At this time, an arc is generated between the contact 4*a* and the (+B1) terminal 5. Foreign particles, e.g., metallic particles and carbide particles, produced by the arc, are scattered and drop onto the insulator 2, and adhere to the (+B2) terminal 6 as well as the (+B1) terminal 5. The foreign particles that adhere onto the sliding paths to be in contact with the contacts 4*a* and 4*b* of the movable contact 4 are pushed and moved by the contacts 4*a* and 4*b* of the moving movable contact 4, and fall into the discharge hole 8 and the arc gaps G while being guided by the notch hole section 7.

When the movable contact 4 reaches the stroke end S2, the ground terminal 3 and the (+B2) terminal 6 are connected by the movable contact 4. The movable contact 4 is moved from this position to the stroke end S2. When the contact 4*a* of the movable contact 4 passes and leaves the end 6*a* of the (+B2) terminal 6, an arc is generated therebetween. The foreign particles produced by the arc are pushed and moved by the contacts 4*a* and 4*b* of the moving movable contact 4, and fall into the discharge hole 8 and the arc gaps G while being guided by the notch hole section 7.

As described above, the notch hole section 7 for discharging the foreign particles produced by arcs is formed in the ground terminal 3 as a common terminal free from arc generation, and the discharge hole 8 is formed in the insulator 2 at the place corresponding in position to the notch hole section 7. The scattered and adhering foreign particles are removed with every sliding motion of the movable contact 4. Therefore, no foreign particles remain between the ground terminal 3 and the movable contact 4, and hence, the ground terminal 3 is not worn. Therefore, a contact state between the movable contact 4 and the ground terminal is stable. No voltage drop occurs. Further, a smooth operation of the switch is ensured.

Figure 3:
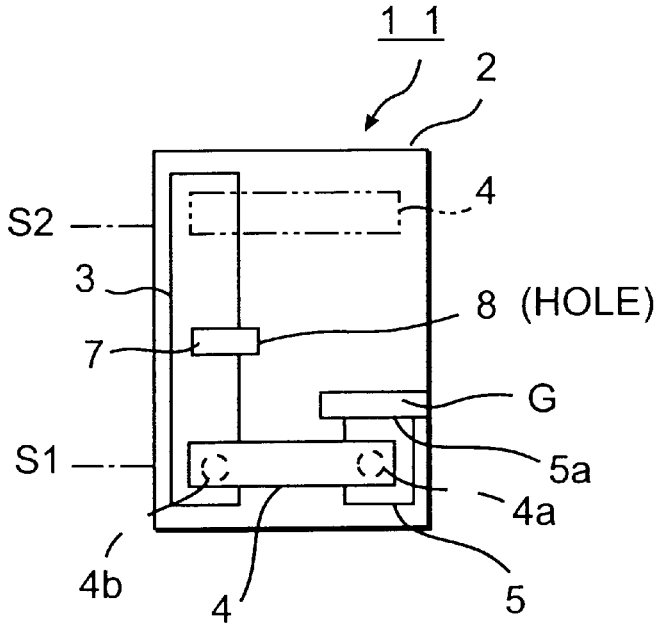
FIG. 3 is a plan view schematically showing a slide switch 11.

FIG. 3 is a plan view schematically showing a slide switch 11, which is another embodiment of the present invention.

Figure 4:
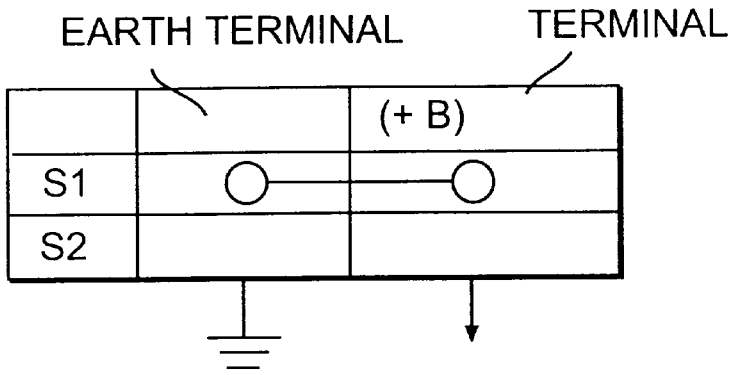
FIG. 4 is a table showing interconnections of the terminals in the slide switch.

FIG. 4 is a table showing interconnections of the terminals in the slide switch 11. In the slide switch 11 of this embodiment, the (+B2) terminal 6, which is used in the slide switch 1 of the first embodiment, is not used. The (+B1) terminal 5 of the slide switch 1 is orientated similar to FIG. 1. The operation of the slide switch 11 is substantially equal to that of the slide switch 1 except the operation on the (+B2) terminal 6 of the slide switch 1.

In each of the slide switches 1 and 11, the width of the notch hole section 7 formed in the ground terminal 3 is substantially equal to each arc gap G. By so selected, the contact 4*b* of the movable contact 4 is prevented from dropping into the notch hole section 7.

What is claimed is:

1. A slide switch to close a current feed circuit to a load by connecting a ground terminal to a power source terminal, comprising:

a body having a first side and a second side, and said body defining at least one opening and a discharge hole;

a ground terminal disposed on said first side of said body, and positioned at least over a portion of said discharge hole, and said ground terminal defining a notch hole section positioned substantially over said discharge hole;

a power source terminal disposed on said second side of said body, and positioned next to said at least one opening; and a movable contact slidably attached to said slide switch having a first contact engaged along said ground terminal, and a second contact selectively engaged along said power source terminal.

2. The slide switch according to claim 1, wherein said power source terminal comprises a plurality of terminals.

3. The slide switch according to claim 2, wherein said first contact consistently engages said ground terminal while said second contact selectively engages each of said plurality of terminals.

4. The slide switch according to claim 2, wherein each of said plurality of terminals has a rectangular shape.

5. The slide switch according to claim 2, wherein said plurality of terminals are intermittently positioned along said second side.

6. The slide switch according to claim 1, wherein said ground terminal is an elongate plate aligned substantially parallel to said first side.

7. The slide switch according to claim 6, wherein said discharge hole is positioned substantially in the middle of said ground terminal.

8. The slide switch according to claim 1, wherein said power source terminal is a rectangular plate.

9. The slide switch according to claim 1, wherein a portion of said at least one opening extends beyond said power source terminal.

10. A slide switch, comprising:

a rectangular insulating body having a surface with first, second, third and fourth corners, wherein said first and second corners are opposite said third and fourth corners, and said body defining a first opening and a discharge hole;

a ground terminal consisting of a rectangular plate disposed on said surface of said rectangular insulating body, spanning a substantial length of said rectangular insulating body from said first corner to said second corner, and positioned at least over a portion of said discharge hole, and said ground terminal defining a notch hole section positioned substantially over said discharge hole;

a power source terminal disposed on said surface of said rectangular insulating body, positioned in said third corner and abutting said first opening; and a movable contact slidably attached to said slide switch, comprising:

a rectangular member with first and second edge sections;

a ground contact attached to said first edge section; and a power source contact attached to said second edge section;

wherein said rectangular member spans a distance between said ground terminal and said power source terminal and said ground contact is positioned to engage said ground terminal, and said power source contact is positioned to selectively engage said power source terminal when said movable contact slides across said surface of said rectangular insulating body.

11. The slide switch according to claim 10, wherein said discharge hole is positioned substantially in the middle of said ground terminal.

12. The slide switch according to claim 10, wherein a portion of said opening extends beyond said power source terminal.

13. The slide switch according to claim 10, further including an additional power source terminal positioned in said fourth corner of said rectangular insulating body.

14. The slide switch according to claim 13, wherein said rectangular insulating body further defines a second opening extending through said rectangular insulating body, and abutting said additional power source terminal.

15. The slide switch according to claim 14, wherein a portion of said additional opening extends beyond said additional power source terminal.

* * * * *